US007578734B2

(12) United States Patent
Ahmed et al.

(10) Patent No.: US 7,578,734 B2
(45) Date of Patent: Aug. 25, 2009

(54) UNIT VENTILATOR HAVING A SPLITTER PLATE AND A PIVOTING DAMPER BLADE ASSEMBLY

(75) Inventors: Syed S. Ahmed, Waco, TX (US); Kevin W. Sawyer, Hewitt, TX (US); Bryan M. Herzog, Waco, TX (US); Kim L. Hall, Waco, TX (US); Kirk W. Beason, Tyler, TX (US)

(73) Assignee: Trane International Inc., Piscataway, NJ (US)

( * ) Notice: Subject to any disclaimer, the term of this patent is extended or adjusted under 35 U.S.C. 154(b) by 425 days.

(21) Appl. No.: 11/455,512

(22) Filed: Jun. 19, 2006

(65) Prior Publication Data

US 2007/0290057 A1 Dec. 20, 2007

(51) Int. Cl.
*F24F 13/12* (2006.01)

(52) U.S. Cl. ..... 454/334; 454/228; 454/261; 454/333; 454/358; 454/259; 236/49.1; 236/49.5

(58) Field of Classification Search ..... 236/49.1, 236/49.3, 49.5; 62/186, 426, 427, 428; 454/228, 454/230, 233, 236, 254, 259, 261, 333, 334, 454/361, 363, 265, 266; 165/42, 62, 126, 165/202, 203, 204
See application file for complete search history.

(56) References Cited

U.S. PATENT DOCUMENTS 607,900 A * 7/1898 Wood ..... 236/38
1,782,711 A 11/1930 Callahan
2,220,355 A 11/1940 Shurtleff
2,755,072 A 7/1956 Kreuttner
3,433,295 A * 3/1969 Avery ..... 165/263
4,228,786 A 10/1980 Frankenfield
4,336,748 A * 6/1982 Martin et al. ..... 454/235
4,610,197 A * 9/1986 Van Becelaere ..... 98/110
5,096,156 A * 3/1992 Wylie et al. ..... 251/77
5,238,453 A * 8/1993 Heil ..... 454/335
5,934,994 A * 8/1999 Wylie et al. ..... 454/333
6,139,425 A * 10/2000 Yazici et al. ..... 454/261
7,089,958 B2 * 8/2006 Schlosser et al. ..... 454/278
2001/0055947 A1 * 12/2001 McCabe ..... 454/369
2003/0097972 A1 * 5/2003 Keller ..... 114/363
2005/0045320 A1 * 3/2005 Richter et al. ..... 165/202
2006/0118291 A1 * 6/2006 Muraki ..... 165/202

* cited by examiner

*Primary Examiner*—Frantz F Jules
*Assistant Examiner*—Daniel C Comings
(74) *Attorney, Agent, or Firm*—William O'Driscoll

(57) ABSTRACT

An HVAC unit ventilator, particularly suited for schools and hotels, includes a single damper blade driven directly by a motor to control a supply air's mixture of return air and outside air. The damper blade is selectively pivotal to a full outside air position, a full return air position, and various intermediate mixed-air positions. The damper blade has flexible edge and end seals that create little if any frictional drag as the damper blade pivots to the intermediate positions, yet the seals provide a positive, tight seal when the damper stops at either the full outside air position or the full return air position. The unit ventilator includes a filter frame that not only supports an air filter but also provides the damper blade with sealing surfaces and structural support. For rigidity, the damper blade has somewhat of a box-like structure that is bi-directionally reinforced by ribs and triangular gussets.

24 Claims, 4 Drawing Sheets

UNIT VENTILATOR HAVING A SPLITTER PLATE AND A PIVOTING DAMPER BLADE ASSEMBLY

BACKGROUND OF THE INVENTION

1. Field of the Invention

The subject invention generally pertains to HVAC unit ventilators such those often used in classrooms and hotels. The invention more specifically pertains to a damper assembly that apportions the amount of outside air and return air to such a ventilator.

2. Description of Related Art

HVAC unit ventilators typically include a blower, heat exchanger, and a damper assembly for independently controlling the heating or cooling of separate rooms of a multi-room building such as a school or hotel. The building may have numerous unit ventilators whose individual heat exchangers receive their heat or cooling energy from a commonly shared source, such as a central boiler or chiller. When a unit ventilator includes a DX coil for cooling, the coil is usually associated with its own condenser rather than a central one.

Unit ventilators are typically mounted against an outer wall of the building so that they can draw in fresh outside air when the outdoor temperature and humidity are favorable and/or draw in return air from within the room. The damper assembly controls the proportions of outside air and return air. After the outside air and/or return air is drawn into the ventilator, the blower forces the air across a filter and the heat exchanger to create a current of clean supply air that discharges into the room for heating, cooling, or ventilation.

Damper assemblies of unit ventilators or other air-mixing equipment often include multiple dampers interconnected by complicated linkages or gears. Examples of such multi-damper systems are disclosed in U.S. Pat. Nos. 2,220,355 and 4,336,748. The linkages and gears for driving and coordinating the movement of the dampers can adversely affect the unit's overall cost and reliability. U.S. Pat. No. 1,782,711 discloses a single damper; however, it also is driven by a linkage assembly.

U.S. Pat. Nos. 607,900 and 2,755,072 each discloses what appears to be a single damper for mixing indoor and outdoor air. These dampers, however, are quite planar, and although that may be fine for their particular application, simple flat dampers do not work well for unit ventilators, which tend to be rather long and narrow. Long, flat damper blades tend to twist and bend, thus they do not seal very well.

Moreover, since unit ventilators are usually installed in the same room as the occupants, the amount of space consumed by the ventilator is a major concern. If a unit ventilator's blower, heat exchanger, damper system and filter are simply stacked one atop the other, the resulting unit can be unreasonably large and bulky.

Consequently, a need exists for a unit ventilator that is simple, robust and compact.

SUMMARY OF THE INVENTION

It is an object of the invention to provide a unit ventilator with a direct-driven damper blade unit that helps control the proportions of outside air and return air being drawn into the ventilator.

Another object of some embodiments is provide a relatively long, narrow damper blade unit with an outside air damper blade, a return air damper blade, and a pair of gussets that combine to create a concavity in the damper blade unit, thereby creating a box-like structure that is more rigid than a simple planar blade.

Another object of some embodiments is to provide a unit ventilator with a filter rack that also serves as a sealing surface against which a damper blade can seal.

Another object of some embodiments is to provide a unit ventilator with a filter rack that provides a damper assembly with structural support.

Another object of some embodiments is to provide a damper blade unit with an outside air damper blade and a return air damper blade, wherein the outside air damper blade and the return air damper blade are blanked and formed from a single piece of sheet metal.

Another object of some embodiments is to stiffen a damper blade with a gusset and a rib that lie perpendicular to each other.

Another object of some embodiments is to cover an outside air damper with a layer of insulation to help prevent frost and condensation from collecting on the damper.

Another object of some embodiments is to install a splitter plate that helps separate the outside air from the return air and to install the splitter plate such that it extends into a concavity of the damper blade unit.

Another object of some embodiments is to provide a splitter plate with notches that allow a gusseted damper blade unit to pivot relative to the splitter plate.

One or more of these and/or other objects of the invention are provided by a unit ventilator that includes a direct-driven damper blade unit that is structurally reinforced by a filter rack and/or a novel gusset and rib design.

DESCRIPTION OF THE PREFERRED EMBODIMENT

Figure 1:
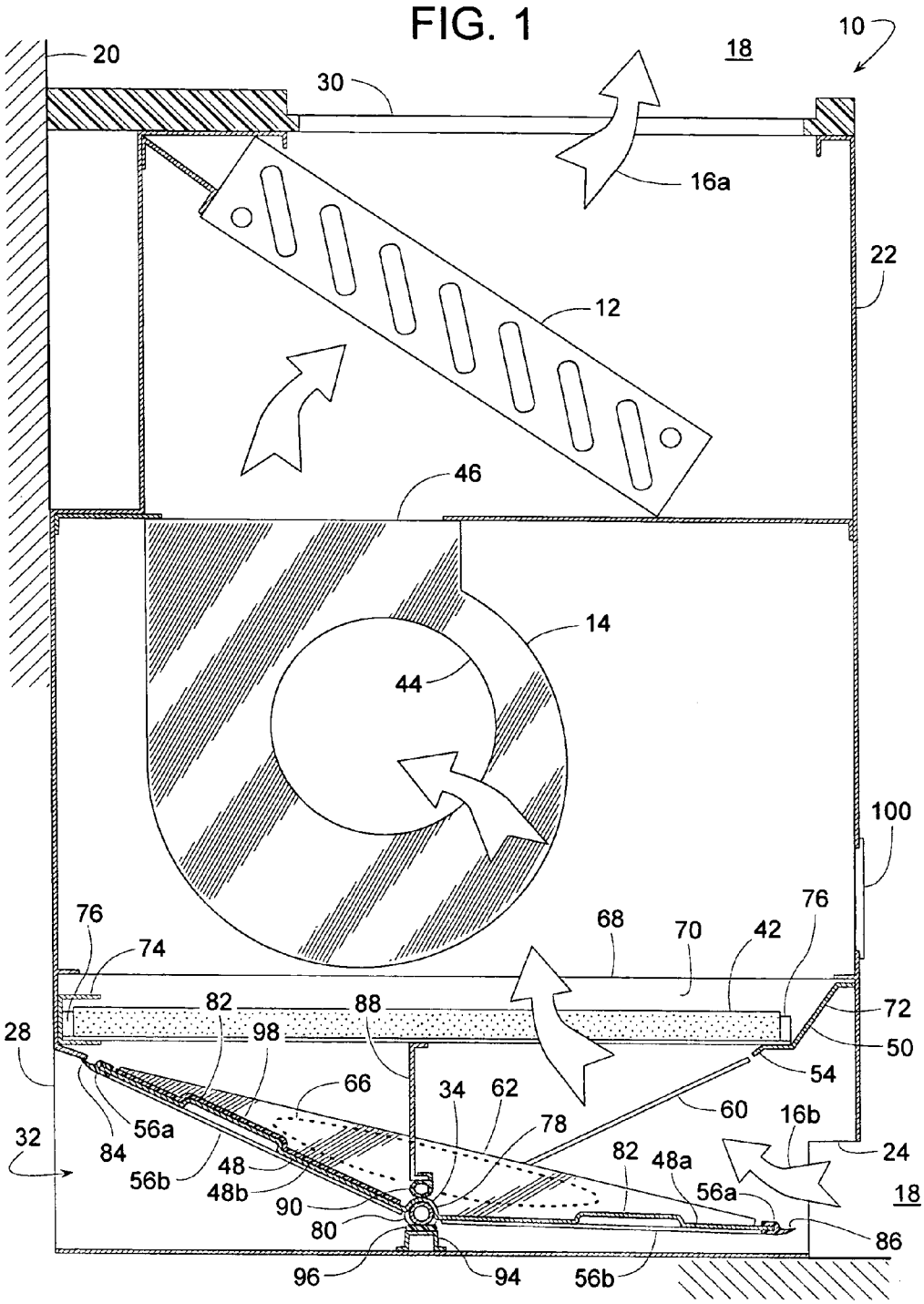
FIG. 1 is a cross-sectional end view a unit ventilator with its damper at a full return air position.
Figure 2:
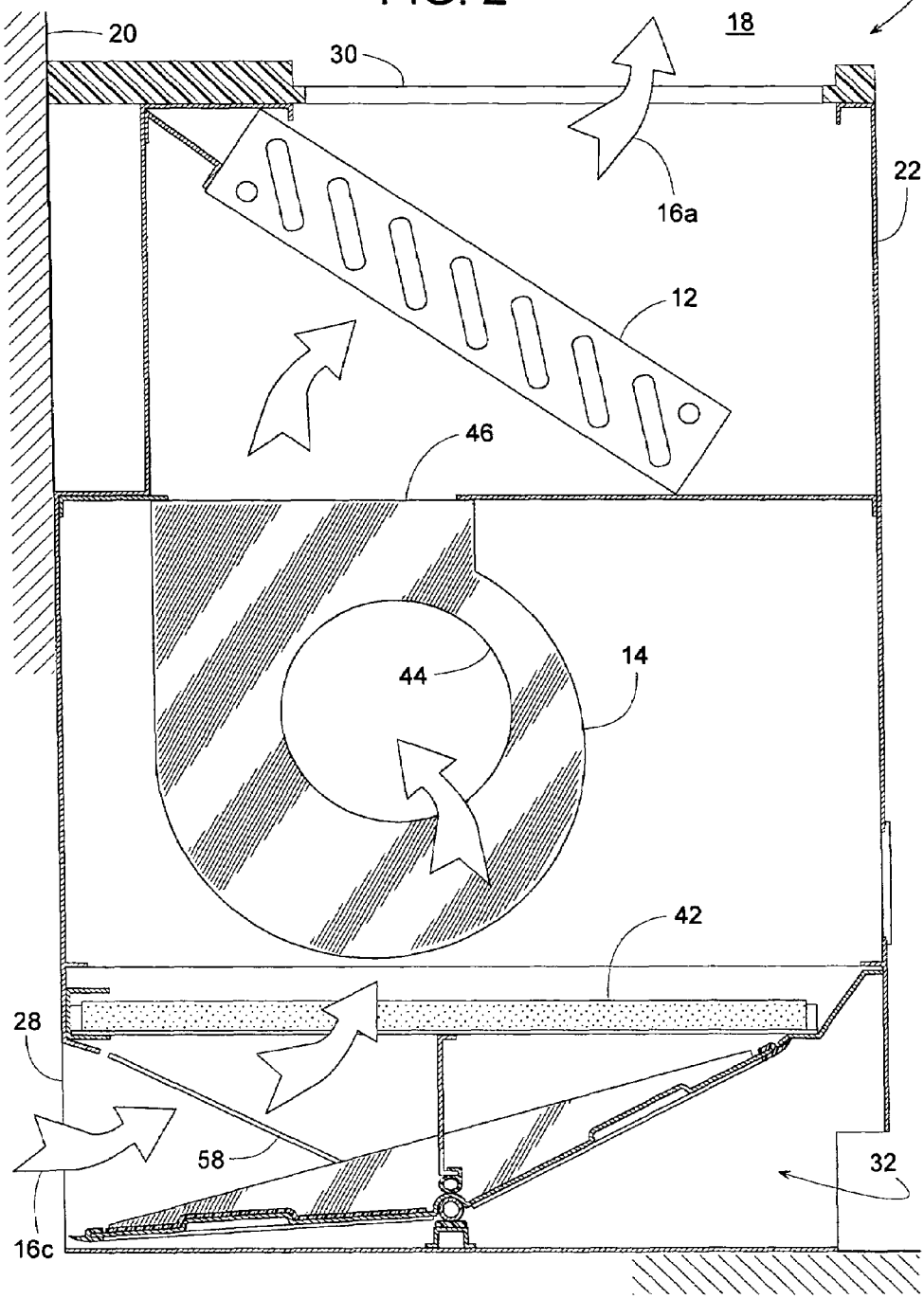
FIG. 2 is a cross-sectional end view similar to FIG. 1 but showing the damper at its full outside air position.
Figure 3:
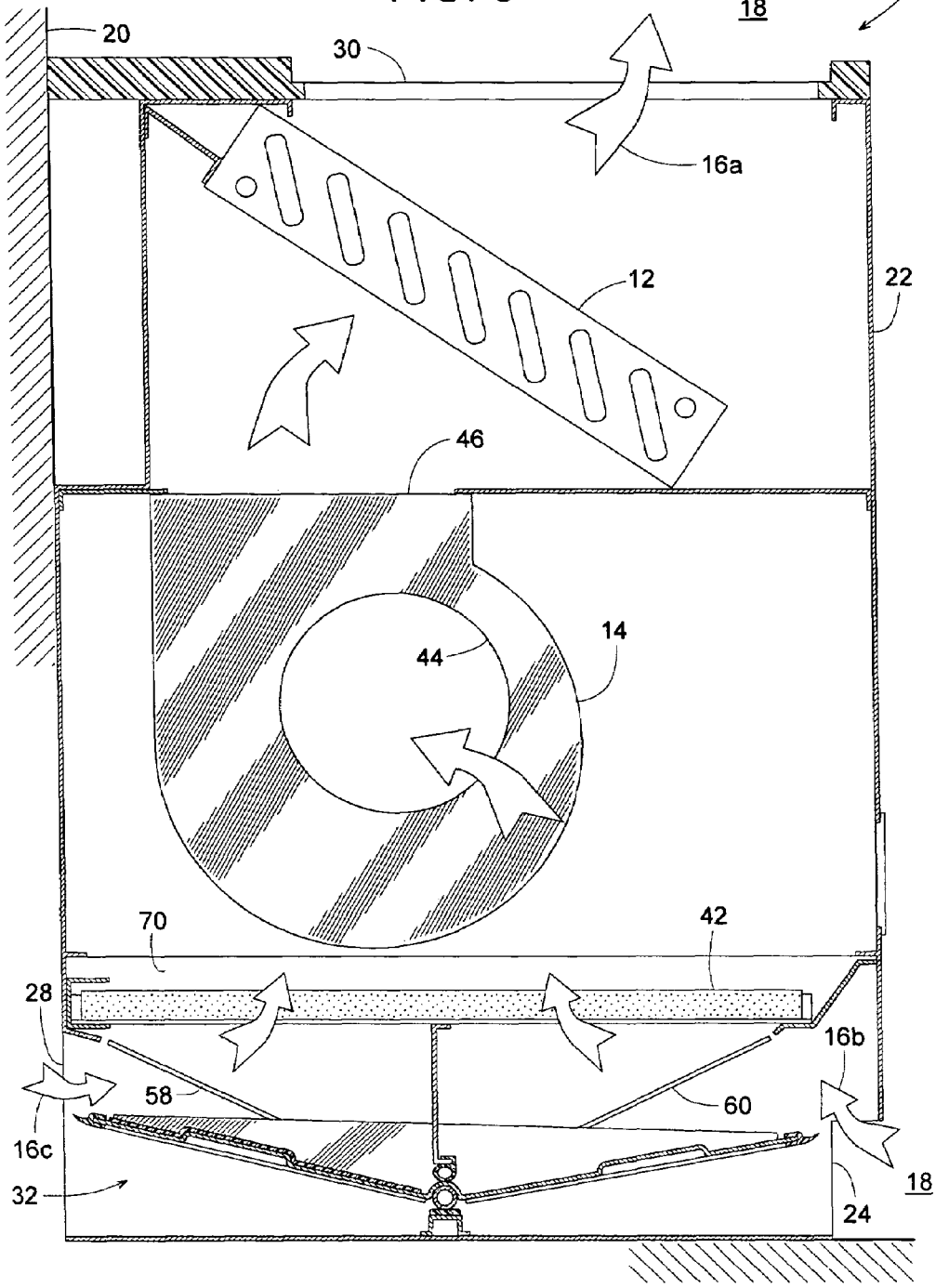
FIG. 3 is a cross-sectional end view similar to FIGS. 1 and 2 but showing the damper at an intermediate position.

Referring to FIGS. 1-3, a unit ventilator 10 includes a heat exchanger 12 (e.g., evaporator, condenser, water chilled coil, water heated coil, electric heater, etc.) and a blower 14 for discharging a current of supply air 16*a* into a comfort zone 18, such as a room or other area within a building 20. Blower 14 and heat exchanger 12 are contained within an enclosure 22 that defines a return air inlet 24 for receiving used return air 16*b* from comfort zone 18, an outside air inlet 28 for receiving fresh outside air 16*c*, and a supply air outlet 30 for releasing supply air 16*a* into comfort zone 18.

Figure 4:
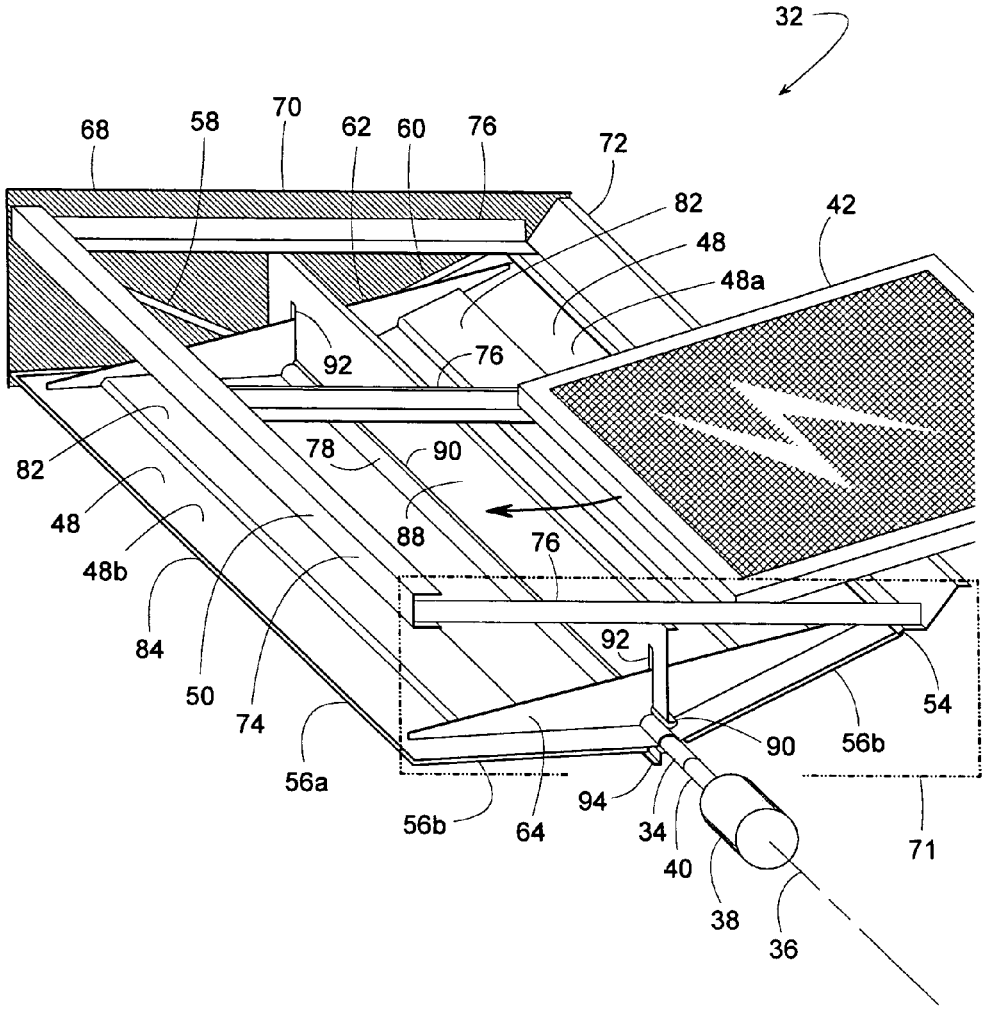
FIG. 4 is a perspective view of the damper assembly used in the unit ventilator of FIGS. 1-3.

Referring further to FIG. 4, ventilator 10 also includes a damper assembly 32 with a damper shaft 34 that can pivot about an axis 36 (longitudinal centerline of shaft 34) to determine the supply air's mixture of outside air 16*c* and return air 16*b*. A drive unit 38, such as an electric motor or some other rotational actuator, includes a drive shaft 40 directly coupled to damper shaft 34 such that damper shaft 34 and drive shaft 40 are inline with axis 36. The direct inline coupling of shafts 34 and 40 eliminates the use of expensive or problematic linkages. Drive unit 38 can be controlled to drive the pivotal motion of damper assembly 32 according to some desired control scheme known to those of ordinary skill in the art.

When drive unit 38 drives damper assembly 32 to a full return air position, as shown in FIG. 1, substantially all of supply air 16*a* is made up of return air 16*b*. In this position, blower 14 draws return air 16*b* in through return air inlet 24 and discharges the air out through supply air outlet 30. With damper assembly 32 in the full return air position, the air travels in series through return air inlet 24, an air filter 42, a blower inlet 44, a blower outlet 46, heat exchanger 12, and supply air outlet 30.

FIGS. 2 and 4 show damper assembly 32 driven to a full outside air position where substantially all of supply air 16*a* is from outside air 16*c*. In the full outside air position, blower 14 draws outside air 16*c* in through outside inlet 28 and discharges the air out through supply air outlet 30. With damper assembly 32 in the full outside air position, the air travels in series through outside air inlet 28, filter 42, blower inlet 44, blower outlet 46, heat exchanger 12, and supply air outlet 30.

FIG. 3 shows damper assembly 32 at an intermediate position where supply air 16*a* is from a mixture of outside air 16*c* and return air 16*b*. In this position, air enters enclosure 22 through both return air inlet 24 and outside air inlet 28. The two streams of air travel upward through filter 42, and a mixture of the two streams travel sequentially through blower inlet 44, blower outlet 46, heat exchanger 12, and supply air outlet 30.

To avoid the problems of previous unit ventilators, damper assembly 32 has several unique features that include, but are not limited to, 1) a single damper blade unit 48 comprising a return air damper blade 48*a* and an outside air damper blade 48*b* directly driven by inline drive unit 38, 2) a filter rack 50 that not only supports filter 42 but also provides damper assembly 32 with structural support, 3) filter rack 50 also defines a sealing surface 54 against which flexible edge seal 56*a* of damper blade unit 48 can seal, 4) rigid sealing edges 58 and 60 offer flexible end seals 56*b* of damper blade unit 48 with a solid abutting surface against which to seal, 5) a first gusset 62 and a second gusset 64 attached to damper blades 48*a* and 48*b* help create a rigid box-like structure with a concavity 66 in damper blade unit 48.

Although the actual structure of damper assembly 32 may vary, in some embodiments, damper assembly 32 comprises two main subassemblies, a stationary frame 68 and pivotal damper blade unit 48. Frame 68 comprises filter rack 50 connected to an inboard endplate 71 and an outboard endplate 70. Inboard endplate 71, which is generally a mirror image of outboard endplate 70, is shown in phantom lines in FIG. 4 to uncover other details of damper assembly 32. Filter rack 50 comprises a front frame member 72, a back frame member 74, and a plurality of cross members 76, which are of a size and quantity to accommodate one or more filters 42. The frame illustrated in FIG. 4 is designed to hold two filters 42 side-by-side. Cross members 76 have a generally L-shaped cross-section. The horizontal flange of the L-shaped members 76 can be used to help support lateral edges of filter 42. A horizontal flange of front frame member 72 and a horizontal flange of back frame member 74 can support front and rear edges of filter 42.

In this example, damper blade unit 48 comprises return air damper blade 48*a* and an outside air damper blade 48*b*. To minimize the number of parts, damper blades 48*a* and 48*b* are blanked and formed from a unitary piece of sheet metal. A central region 78 of damper blade unit 48 is affixed to damper shaft 34 using screws or some other appropriate attachment means. Endplates 70 and 71 each include a journal bearing 80 for supporting damper shaft 34 so that damper blade unit 48 can pivot relative to frame 68.

For rigidity along the length of damper blade unit 48, damper blades 48*a* and 48*b* each include an integrally formed rib 82 that runs generally parallel to axis 36, and blades 48*a* and 48*b* lie at an angle to each other, i.e., blades 48*a* and 48*b* are not coplanar. Thus, an outside air damper blade tip 84 and a return air damper blade tip 86 define an imaginary plane that is offset to axis 36. To add rigidity across the damper blade unit's width (as measured perpendicular to axis 36 from return air damper blade tip 84 to an outside damper blade tip 86), gussets 62 and 64 are attached to damper blades 48*a* and 48*b*. As a result, damper blades 48*a* and 48*b*, gussets 62 and 64, and ribs 82 provides damper blade unit 48 with a box-like structure that is rigid in directions both parallel and perpendicular to axis 36.

To help separate the return and outside air, a stationary splitter plate 88 attached to endplates 70 and 71 and further attached to one or more cross-members 76 extends into concavity 66. A flexible seal 90 attached to the lower edge of splitter member 88 seals against central region 78 of damper blade unit 48. Splitter plate 88 has notches 92 to accommodate gussets 62 and 64. A dividing member 94 underneath shaft 34 and attached to endplates 70 and 71 also helps separate the return air and outside air. A flexible seal 96 attached to dividing member 94 help seal any gap between shaft 34 and dividing member 94.

Another important feature of damper assembly 32 is its ability to provide a solid tight seal at both its full return air position of FIG. 1 and its full outside air position of FIG. 2, and yet drive unit 38 only needs to overcome minimal frictional sealing drag when damper assembly 48 is at some intermediate position, such as the position shown in FIG. 3. To accomplish this, end seals 56*b* and edge seals 56*a* have little or no contact with frame 68 when damper assembly 32 is at some intermediate position (FIG. 3); however, the sealing forces increase dramatically when damper assembly 32 reaches the full return air position (FIG. 1) or the full outside air position (FIG. 2). At the full return air position (FIG. 1), edge seal 56*a* firmly abuts a lower surface of back frame member 74, and end seals 56*b* firmly abut sealing edges 58 that protrude from endplates 70 and 71. Likewise, at the full outside air position (FIG. 2), edge seal 56*a* firmly abuts a lower surface of front frame member 72, and end seals 56*b* firmly abut sealing edges 60 that protrude from endplates 70 and 71. Although the structure of seals 56*a* and 56*b* may vary, in some embodiments seals 56*a* and 56*b* are made of a flexible neoprene-like material.

To help prevent frost and condensation from collecting on outside damper blade 48*b*, in some embodiments a layer of thermal insulation 98 overlies damper blade 48*b*.

In a currently preferred embodiment, enclosure 22 includes an access panel 100 for periodically replacing filter 42.

Although the invention is described with respect to a preferred embodiment, modifications thereto will be apparent to those of ordinary skill in the art. Therefore, the scope of the invention is to be determined by reference to the following claims.

The invention claimed is:

1. A unit ventilator for drawing return air from a comfort zone, drawing outside air from outside the comfort zone, and delivering supply air to the comfort zone, wherein the supply air is a product of at least one of the return air and the outside air after being filtered or otherwise conditioned by the ventilator, the unit ventilator comprising:

an enclosure defining a return air inlet for receiving the return air from the comfort zone, an outside air inlet for receiving the outside air from outside the comfort zone, and a supply air outlet for discharging the supply air into the comfort zone;

a blower disposed within the enclosure to help force the supply air into the comfort zone; and a damper blade unit disposed within the enclosure, wherein:

a) the damper blade unit is pivotal about an axis;

b) the damper blade unit includes a return air damper blade, an outside air damper blade, a first gusset, and a second gusset, wherein the return air damper blade, the outside air damper blade, the first gusset, and the second gusset are in a substantially fixed relationship to each other;

c) the return air damper blade includes a return air damper blade tip;

d) the outside air damper blade includes an outside air damper blade tip;

e) the return air damper blade tip and the outside air damper blade tip are substantially parallel to the axis;

f) the return air damper blade tip and the outside air damper blade tip define a plane that is offset to the axis; and g) the first gusset and the second gusset extend from the return air damper blade to the outside air damper blade such that the return air damper blade, the outside air damper blade, the first gusset and the second gusset define a concavity within the damper blade unit; and h) a splitter plate lying substantially parallel to the axis and extending into the concavity, wherein the damper blade unit is pivotal relative to the splitter plate.

2. The unit ventilator of claim 1, further comprising a filter rack disposed within the enclosure and a filter supported by the filter rack, wherein the damper blade unit is selectively pivotal to a full return air position and a full outside air position such that the damper blade unit seals against the filter rack in at least one of the full return air position and the full outside air position.

3. The unit ventilator of claim 2, wherein the return air damper blade tip is spaced apart from the filter rack when the damper blade unit is at the full return air position, and the outside air damper blade tip is spaced apart from the filter rack when the damper blade unit is at the full outside air position.

4. The unit ventilator of claim 1, wherein the return air damper blade and outside air damper blade are an integral extension of each other such that the return air damper blade and outside air damper blade comprise a unitary piece.

5. The unit ventilator of claim 1, further comprising a rib disposed on the return air damper blade, wherein the rib runs substantially parallel to the axis and is interposed between the axis and the return air damper blade tip.

6. The unit ventilator of claim 1, further comprising a rib disposed on the outside air damper blade, wherein the rib runs substantially parallel to the axis and is interposed between the axis and the outside air damper blade tip.

7. The unit ventilator of claim 1, further comprising a layer of insulation disposed on the return air damper blade.

8. The unit ventilator of claim 1, wherein the splitter plate defines a notch into which at least one of the first gusset and the second gusset extends.

9. The unit ventilator of claim 1, further comprising a drive motor with a shaft coupled to the damper blade unit with the shaft being substantially inline with the axis.

10. A unit ventilator for drawing return air from a comfort zone, drawing outside air from outside the comfort zone, and delivering supply air to the comfort zone, wherein the supply air is a product of varying proportions of the return air and the outside air filtered by a filter, the unit ventilator comprising:

an enclosure defining a return air inlet for receiving the return air from the comfort zone, an outside air inlet for receiving the outside air from outside the comfort zone, and a supply air outlet for discharging the supply air into the comfort zone;

a blower disposed within the enclosure to help force the supply air into the comfort zone;

a splitter plate;

a filter rack disposed within the enclosure for supporting the filter; and a damper blade unit comprising a return air damper blade for guiding the return air and an outside air damper blade for guiding the outside air, wherein:

a) the return air damper blade includes a return air damper blade tip;

b) the outside air damper blade includes an outside air damper blade tip;

c) the return air damper blade and the outside air damper blade are in a substantially fixed relationship to each other;

d) the damper blade unit is pivotal about an axis relative to the enclosure to help determine the proportion of the return air and the outside that make up the supply air; and e) the damper blade unit is selectively pivotal to a full return air position and a full outside air position such that the damper blade unit seals against the filter rack in at least one of the full return air position and the full outside air position; and f) the splitter plate is disposed above the axis and lies substantially parallel thereto, wherein the damper blade unit is pivotal relative to the splitter plate.

11. The unit ventilator of claim 10, wherein the return air damper blade tip is spaced apart from the filter rack when the damper blade unit is at the full return air position, and the outside air damper blade tip is spaced apart from the filter rack when the damper blade unit is at the full outside air position.

12. The unit ventilator of claim 10, wherein the return air damper blade and outside air damper blade are an integral extension of each other such that the return air damper blade and outside air damper blade comprise a unitary piece.

13. The unit ventilator of claim 10, further comprising a rib disposed on the return air damper blade, wherein the rib runs substantially parallel to the axis and is interposed between the axis and the return air damper blade tip.

14. The unit ventilator of claim 10, further comprising a rib disposed on the outside air damper blade, wherein the rib runs substantially parallel to the axis and is interposed between the axis and the outside air damper blade tip.

15. The unit ventilator of claim 10, further comprising a layer of insulation disposed on the return air damper blade.

16. The unit ventilator of claim 10, further comprising a first gusset and a second gusset extending between the outside damper blade and the return air damper blade, wherein the splitter plate defines a notch into which at least one of the first gusset and the second gusset extends.

17. The unit ventilator of claim 10, further comprising a drive motor with a shaft coupled to the damper blade unit with the shaft being substantially inline with the axis.

18. A unit ventilator for drawing return air from a comfort zone, drawing outside air from outside the comfort zone, and delivering supply air to the comfort zone, wherein the supply air is a product of varying proportions of the return air and the outside air filtered by a filter, the unit ventilator comprising:

an enclosure defining a return air inlet for receiving the return air from the comfort zone, an outside air inlet for receiving the outside air from outside the comfort zone, and a supply air outlet for discharging the supply air into the comfort zone;

a blower disposed within the enclosure to help force the supply air into the comfort zone;

a filter rack disposed within the Enclosure for supporting the filter;

a splitter plate disposed within the enclosure; and a damper blade unit disposed within the enclosure, wherein:

a) the damper blade unit is pivotal about an axis to help determine the proportion of the return air and the outside that make up the supply air;

b) the damper blade unit includes a return air damper blade, an outside air damper blace, a first gusset, and a second gusset, wherein the return air damper blade, the outside air damper blade, the first gusset, and the second gusset are in a substantially fixed relationship to each other;

c) the return air damper blade includes a return air damper blade tip;

d) the outside air damper blade includes an outside air damper blade tip;

e) the return air damper blade tip and the outside air damper blade tip are substantially parallel to the axis;

f) the return air damper blade tip and the outside air damper blade tip define a plane that is offset to the axis;

g) the first gusset and the second gusset extend from the return air damper blade to the outside air damper blade such that the return air damper blade, the outside air damper blade, the first gusset and the second gusset define a concavity within the damper blade unit;

h) the damper blade unit is selectively pivotal to a full return air position and a full outside air position such that the damper blade unit seals against the filter rack in at least one of the full return air position and the full outside air positions;

i) the splitter plate lies substantially parallel to the axis and extends into the concavity; and j) the damper blade unit is pivotal relative to the splitter plate.

19. The unit ventilator of claim 18, wherein the return air damper blade tip is spaced apart from the filter rack when the damper blade unit is at the full return air position, and the outside air damper blade tip is spaced apart from the filter rack when the damper blade unit is at the full outside air position.

20. The unit ventilator of claim 18, wherein the return air damper blade and outside air damper blade are an integral extension of each other such that the return air damper blade and outside air damper blade comprise a unitary piece.

21. The unit ventilator of claim 18, further comprising a rib disposed on the return air damper blade, wherein the rib runs substantially parallel to the axis and is interposed between the axis and the return air damper blade tip.

22. The unit ventilator of claim 18, further comprising a rib disposed on the outside air damper blade, wherein the rib runs substantially parallel to the axis and is interposed between the axis and the outside air damper blade tip.

23. The unit ventilator of claim 18, wherein the splitter plate defines a notch into which at least one of the first gusset and the second gusset extends.

24. The unit ventilator of claim 18, further comprising a drive motor with a shaft coupled to the damper blade unit with the shaft being substantially inline with the axis.

* * * * *